United States Patent [19]

Muller

[11] 4,135,570

[45] Jan. 23, 1979

[54] FOUNDRY MOLDING INSTALLATION FOR PRODUCING BOXLESS SAND MOLDS

[75] Inventor: Günter Müller, Karlsruhe, Fed. Rep. of Germany

[73] Assignee: ARENCO-BMD Maschinenfabrik GmbH, Fed. Rep. of Germany

[21] Appl. No.: 795,449

[22] Filed: May 10, 1977

[30] Foreign Application Priority Data

May 17, 1976 [DE] Fed. Rep. of Germany ..... 2621935

[51] Int. Cl.[2] ..... B22C 15/00; B22C 17/00

[52] U.S. Cl. ..... 164/182; 164/187; 164/194

[58] Field of Search ..... 164/187, 213, 200, 195, 164/194, 182, 37

[56] References Cited

U.S. PATENT DOCUMENTS

| | | | |
|---|---|---|---|
| 3,406,738 | 10/1968 | Hunter | 164/194 X |
| 3,516,475 | 6/1970 | Dougherty | 164/37 |
| 3,556,196 | 1/1971 | Buhler | 164/187 X |
| 3,618,668 | 11/1971 | Dupre et al. | 164/182 X |
| 3,630,268 | 12/1971 | Hatch | 164/181 |
| 3,907,482 | 9/1975 | Shiota et al. | 425/435 |
| 3,916,976 | 11/1975 | Miller et al. | 164/37 |
| 4,034,795 | 7/1977 | Otoki | 164/182 X |

*Primary Examiner*—Robert L. Spicer, Jr.
*Attorney, Agent, or Firm*—Craig & Antonelli

[57] ABSTRACT

A foundry molding installation for producing boxless (or flaskless) sand molds comprises a molding machine having a pattern plate (or match plate) for simultaneous molding of upper and lower bodies (or mold halves) and a shifting device for transporting a molded lower body to a transfer station and simultaneously returning to the molding station, for assembly with the upper body therein, a lower body which has been provided with cores. The cores are inserted at core insertion stations along the sides of a rectangular, closed circulation, roller track which is mainly disposed outside the molding machine. At the molding-machine end the track comprises a tandem shifting apparatus having a transfer station in common with that of the shifting device of the molding machine and being movable back and forth, over the shifting device, so as to return a cored lower body from one side of the track to the transfer station while feeding a fresh lower body to the other side of the track. At the other end of the track sides, the circulation of lower bodies is effected by a transfer carriage which runs on rails from one side to the other and incorporates a section of roller track matching that of the sides of the rectangle. The shifting device may be a turntable having recessed seatings for the lower bodies, a lifting apparatus being provided below the turntable for raising the body out of the turntable and into the tandem shifting apparatus.

7 Claims, 2 Drawing Figures

FOUNDRY MOLDING INSTALLATION FOR PRODUCING BOXLESS SAND MOLDS

Figure 1:
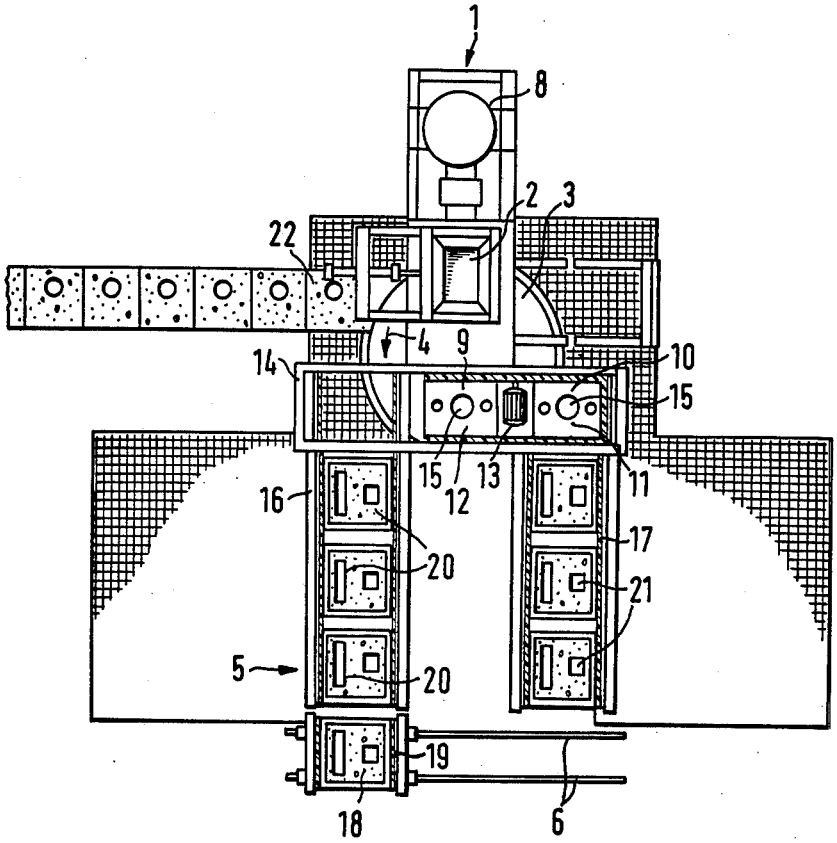

The invention relates to a foundry molding installation for producing boxless (or flaskless) sand molds, comprising a molding machine having a pattern plate (or match plate) with upper and lower body forms, a molding sand compacting apparatus which acts towards the pattern plate from above and from below for the simultaneous molding of an upper body and a lower body (or upper and lower mold halves) and also having a shifting device by means of which a molded lower body is transported from the molding station towards a core insertion station situated outside the compacting apparatus and at the same time a lower body provided with cores, which has returned from the core insertion station, is transported to the molding station so that the upper body can be applied to it.

Several constructional forms of such molding installations are already known, and these can be divided substantially into two types, namely those in which the boxless sand molds are molded and cast with a horizontal joint and those in which they are molded and cast with a vertical joint.

As compared with conventional box (or flask) molding machines, the aforesaid molding installations reduce the outlay required for the molding boxes (or copes and drags) and dispense with the transporting means required for such boxes. Furthermore, the boxless molding machines are suitable more particularly for automatic foundry work with relatively large series of workpieces. The working speed of such molding installations, however, is determined by the time required for inserting the cores in the mold, and this may be considerable more particularly if the mold comprises many cores or cores of a complicated shape.

If the lower body and upper body are produced in separate molding machines, the influence on the working speed of the time which is required for insertion of the cores is not so serious, since any number of core insertion stations can be provided before the upper body is added to the lower body. But this advantage is at the expense of a relatively considerable outlay on machinery.

With a molding machine as initially specified in the introductory paragraph hereof (see also DT-PS 23 34 245) wherein all working stations, namely the molding station, the core insertion station and the application station, are combined in a single machine, and two lower bodies, in addition to an upper body, are situated in the machine at the same time. The cycle speed of the molding machine is determined substantially exclusively by the time required for the insertion of the cores, whereby the economic advantages of the molding installation may be evidenced in certain cases.

An object of the invention is to provide a further improved molding machine of the construction initially specified, whereby it is also possible to produce molds with a large number of cores and/or cores of any desired shape without prolonging the cycle time, which is determined by the molding operation and the putting together of upper and lower boxes.

This object is achieved in accordance with the invention by the provision of a closed circulation track for the lower bodies which is mainly disposed outside the molding machine and has two or more core insertion stations, which track has a transfer station in common with the said shifting device and is provided for transporting the lower bodies from the transfer station to the core insertion stations and from these back to the transfer station without alteration to the relative position of the lower bodies with respect to the molding and application station.

With this construction it is possible to provide any desired number of core insertion stations at the circulation track, so that even castings of complicated construction and with complicated cavity formations can be produced in an economical manner with boxless sand molds. The molded lower body is moved by the shifting device to the transfer station within the molding machine whilst the upper body remains in the molding station. At the transfer station the lower body is taken from the circulation track and transported one step further to the core insertion stations, whilst at the same time a lower body provided with cores is discharged at the transfer station from the circulation track to the shifting device. At the next working cycle this lower body is moved into the molding station where, after the pattern plate has moved out, the application apparatus applies the upper body. Then the complete mold is ejected from the machine.

Preferably, in order to obtain the shortest possible working cycle, the circulation track is arranged to carry out its transporting steps during the time when the shifting apparatus is at a standstill, that is to say during the molding operation and during the putting together of the upper and lower bodies.

Preferably the lower-body circulation track is constructed as a rectangular track so that the lower bodies are moved only parallel to the coordinates of the rectangle. This construction ensures that the lower bodies, whilst they are being transported on the circulation track, do not change their positions relatively to the molding station, so that at the molding station, when the upper body is applied, the lower body is still in the same position as it was in during molding.

In order to obtain friction-free transfer from the shifting device to the circulation track and vice versa, the circulation track, at least in the region of the transfer station, is situated in a plane above the plane of movement of the shifting device of the molding machine.

According to a preferred constructional form, the circulation track comprises two parallel driven roller tracks, a tandem shifting apparatus having two loading places which apparatus connects the roller tracks at one of their ends and travels over the transfer station, and a transfer carriage which runs on rails and connects the roller tracks at their other ends.

The tandem shifting apparatus provides the facility that at one of its loading places a fresh lower body, and at its other loading place a lower body which has been provided with cores, can be accepted. After one step of movement of the tandem shifting apparatus, the fresh lower body is discharged to the roller track with the core insertion stations, and the finished lower body is delivered to the shifting device at the transfer station.

Since the core insertion stations are situated at the two parallel roller tracks, and the lower bodies are moved only parallel to the coordinates of the rectangular circulation track, the advantage is obtained that one half of the molding box is accessible in each case from outside the two roller tracks, so that the cores can be inserted in a simple manner even with very large molding boxes. Furthermore it is possible with this construction of the circulation track to arrange the core insertion stations at the position desired by the foundry and at the desired working height.

In the molding machine initially described (DT-PS 24 34 245), there is provided, as a shifting device integral with the machine, a turntable which has two working positions, namely a molding position and a core insertion position. Naturally, the invention can be applied also to shifting devices which operate in a linear fashion.

When using a turntable as a shifting device, the lower bodies are mounted sunk into a recess in the table. In this case, according to a feature of the invention, there is arranged below the turntable a lifting apparatus which lifts the lower body out of the turntable and raises it to the plan of movement of the tandem shifting apparatus.

Further details and advantages of the invention will become apparent from the following description of a preferred constructional form with reference to the accompanying drawings.

FIG. 1 shows a diagrammatic plan view of a molding machine comprising the shifting device and the circulation track with a plurality of core insertion stations.

Figure 2:
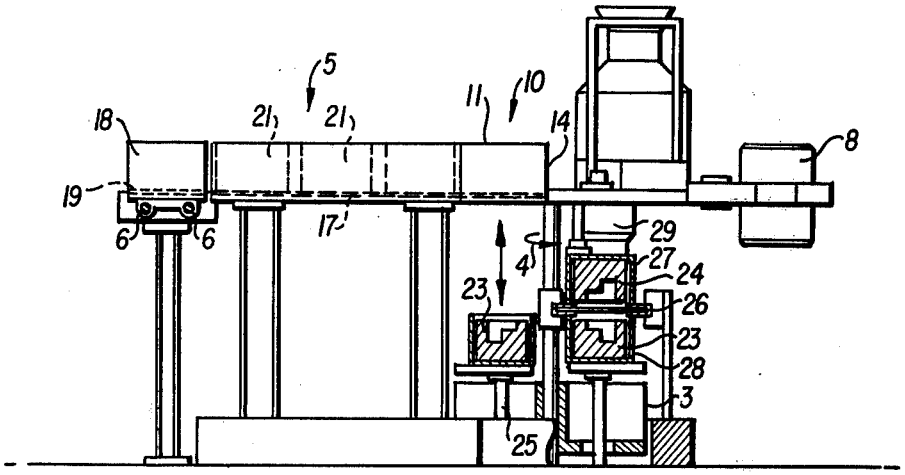

FIG. 2 shows a diagrammatic side view of the same molding machine illustrated in FIG. 1. The drawing of FIG. 2 shows a molding machine 1 with a molding station 2 at which upper bodies 24 and lower bodies 23 are produced at the same time by means of a single pattern plate 26, which has the upper body form 27 on its upper side and the lower body form 28 on its lower side, and by means of a compacting apparatus 29 acting towards the pattern plate 26 from above and below, for example, a sand discharging and compressing apparatus of the type disclosed by U.S. Pat. No. 3,807,483, of which only the compressed air chamber 8 is shown in FIG. 1. The molding machine 1 also comprises a shifting device in the form of a turntable 3 which rotates in the direction of arrow 4 with two work positions, one of which is the molding station 2 whereas the other position is a transfer station 9.

The transfer station 9 is at the same time a position on a circulation track 5. The latter, in the illustrated constructional example of FIG. 1, consists of a tandem shifting apparatus 10, two parallel roller tracks 16, 17 and a transfer carriage 18 which runs on rails 6. The circulation track 5 is arranged in the form of a rectangle so that the lower bodies 23 may be transported from the transfer station 9 to core insertion stations 20 and 21 and back without alteration of the relative position of the lower bodies 23 with respect to the molding station 2. The tandem shifting apparatus 10 is arranged above this transfer station 9 and comprises two loading places 11 and 12. The tandem shifting apparatus 10 is movable back and forth along a rail frame 14 by means of a drive 13 and is illustrated to the extent of one lower-body position or one loading place 11 — in the drawing of FIG. 1 towards the left. Each loading place 11 and 12 of the tandem shifting apparatus 10 comprises a gripping device (which may be of a known type) for the lower bodies 23, which can be lifted and lowered by means of a drive 15.

At one end, the roller tracks 16 and 17 extend to beneath the rail frame 14 of the tandem shifting apparatus 10. At the other end of the roller tracks 16 and 17, the transfer carriage 18 is located, which has a roller track section 19 that prolongs the parallel roller tracks and, in its two end positions, finishes flush with the roller tracks 16 and 17. By means of a drive (not shown) which may be of known construction, the transfer carriage 18 with a lower body 23 can be displaced from one roller track 16 to the other roller track 17 and returned empty.

In this constructional example three stations 20 and three stations 21 are provided at the parallel roller tracks 16 and 17, respectively, for insertion of cores and for carrying out other auxiliary work. With this method of moving the lower bodies 23 within a square or rectangle around circulation track 5, the mold half facing the operator in each case at the core insertion stations 20 or 21 can be fitted with cores, so that easy insertion is possible even with molds of large dimensions.

After the molding of the lower bodies 23 and upper bodies 24 at the molding station 2 and the lowering of the lower body 23 on to the turntable 3, the latter carries out a rotation through 180° in the direction of the arrow 4 so that this lower body 23 is moved to the transfer station 9; at the same time, the lower body 23 situated at the transfer station 9 and provided with cores moves by the rotation of the turntable 3 into the molding station 2, from which the pattern plate 26 has previously been moved out, so that the upper body 23 can be applied and then the finished sand mold 22 can be ejected.

The fresh lower body 23 situated at the transfer station 9 is lifted out of the turntable 3, received by the tandem shifting apparatus 10 at loading place 12 and delivered to the roller track 16, whilst at the same time the lower body 23 which is situated at the other loading place 11, having come from the core insertion stations 20, 21 is lowered to the transfer station 9 and is delivered from there by rotation through 180° of the turntable 3 to the recessed seating in the turntable 3.

What is claimed is:

1. Foundry molding installation for producing boxless sand molds, comprising:

a molding machine, a molding station having a molding sand compacting means for the simultaneous molding of an upper body and a lower body, a shifting device for moving the molded lower body from the molding station towards a core insertion station situated outside the compacting means and at the same time transporting another lower body, which has been provided with cores and has returned from the core insertion station, back to the molding station for the application of the upper body, and a closed circulation track for the lower bodies which is mainly disposed outside the molding machine and has two or more core insertion stations, which track has a transfer station in common with that of the shifting device of the molding machine, the said track being provided for transporting the lower bodies from the transfer station to the core insertion stations and from these core insertion stations back to the transfer station without alteration of the relative position of the lower bodies with respect to the molding station.

2. Molding installation according to claim 1, wherein the circulation track is operated while the shifting device of the molding machine is stopped.

3. Molding installation according to claim 1, wherein the circulation track is constructed as a rectangular track such that the lower bodies are transported only parallel to the coordinates of the rectangle.

4. Molding installation according to claim 1, wherein the circulation track, at least in the region of the transfer station, is situated in a plane above a plane in which the movement of the said shifting device occurs.

5. Molding installation according to claim 1, wherein the circulation track further comprises:

two parallel driven roller tracks, a tandem shifting apparatus having two loading places which connects these roller tracks at one of their ends and is arranged to travel over the transfer station, and a transfer carriage which runs on rails and connects the roller tracks at their other ends.

6. Molding installation according to claim 5, wherein the circulation track is constructed as a rectangular track such that the lower bodies are transported only parallel to the coordinates of the rectangle.

7. Molding installation according to claim 5, wherein the said shifting device is in the form of a turntable which is recessed for receiving the lower bodies mounted thereon in a sunken fashion, and below the turntable a lifting apparatus is provided for lifting the lower body out of the turntable and raising it to the plane of movement of the tandem shifting apparatus.

* * * * *